US005180551A

United States Patent [19]

Agarwal

[11] Patent Number: 5,180,551

[45] Date of Patent: Jan. 19, 1993

[54] GOLD ALLOYS OF EXCEPTIONAL YELLOW COLOR AND REVERSIBLE HARDNESS

[75] Inventor: Dwarika P. Agarwal, Attleborough, Mass.

[73] Assignee: Leach & Garner Co., N. Attleboro, Mass.

[21] Appl. No.: 784,766

[22] Filed: Oct. 30, 1991

[51] Int. Cl.[5] ..... C22C 5/02

[52] U.S. Cl. ..... 420/511; 148/501; 148/405

[58] Field of Search ..... 420/511; 148/405, 430, 148/501, 678

[56] References Cited

U.S. PATENT DOCUMENTS 1,917,378 7/1933 Lenfant ..... 420/511
2,169,592 8/1938 Peterson ..... 420/511

FOREIGN PATENT DOCUMENTS 55-145137 12/1980 Japan .
63-169346 7/1988 Japan .
63-259042 10/1988 Japan .

*Primary Examiner*—R. Dean
*Assistant Examiner*—Margery S. Phipps
*Attorney, Agent, or Firm*—George W. Dishong

[57] ABSTRACT

A unique hardenable gold based alloy, especially a 14 karat gold alloy containing gold, silver, copper, zinc, cobalt and an alternative alloy additionally containing iridium. The alloy has a fine grained structure, a lower hardness in the soft condition, a nice yellow color and a capability to be hardened to an exceptional hardness value. The alloy contains approximately 58.3% gold (Au), between about 10% to about 14% silver (Ag), between about 2.5% to about 3.0% zinc (Zn), between about 0.2% to about 1.0% cobalt (Co) and the balance of the alloy being copper (Cu) with the special provision that the ratio of the weight percent amounts of copper to, the sum of the silver and two (2) times the zinc amount, [Cu/(Ag+2Zn)], has a value of between about 1.3 to about 2.5. The copper to silver weight percent ratio [Cu/Ag] of between about 2.0 to about 3.8, in combination with the ratio of copper to, silver+2×zinc, [Cu/(Ag+2Zn)] results in a gold alloy with a heretofor unachievable combination of a most desirable yellow color and an exceptional degree of reversible hardness. The alloy may also contain a weight percent amount of between about 0.003 to about 0.03 iridium (Ir) which results in a gold alloy with the above characteristics but also provides for an alloy having a very fine grained structure.

2 Claims, 1 Drawing Sheet

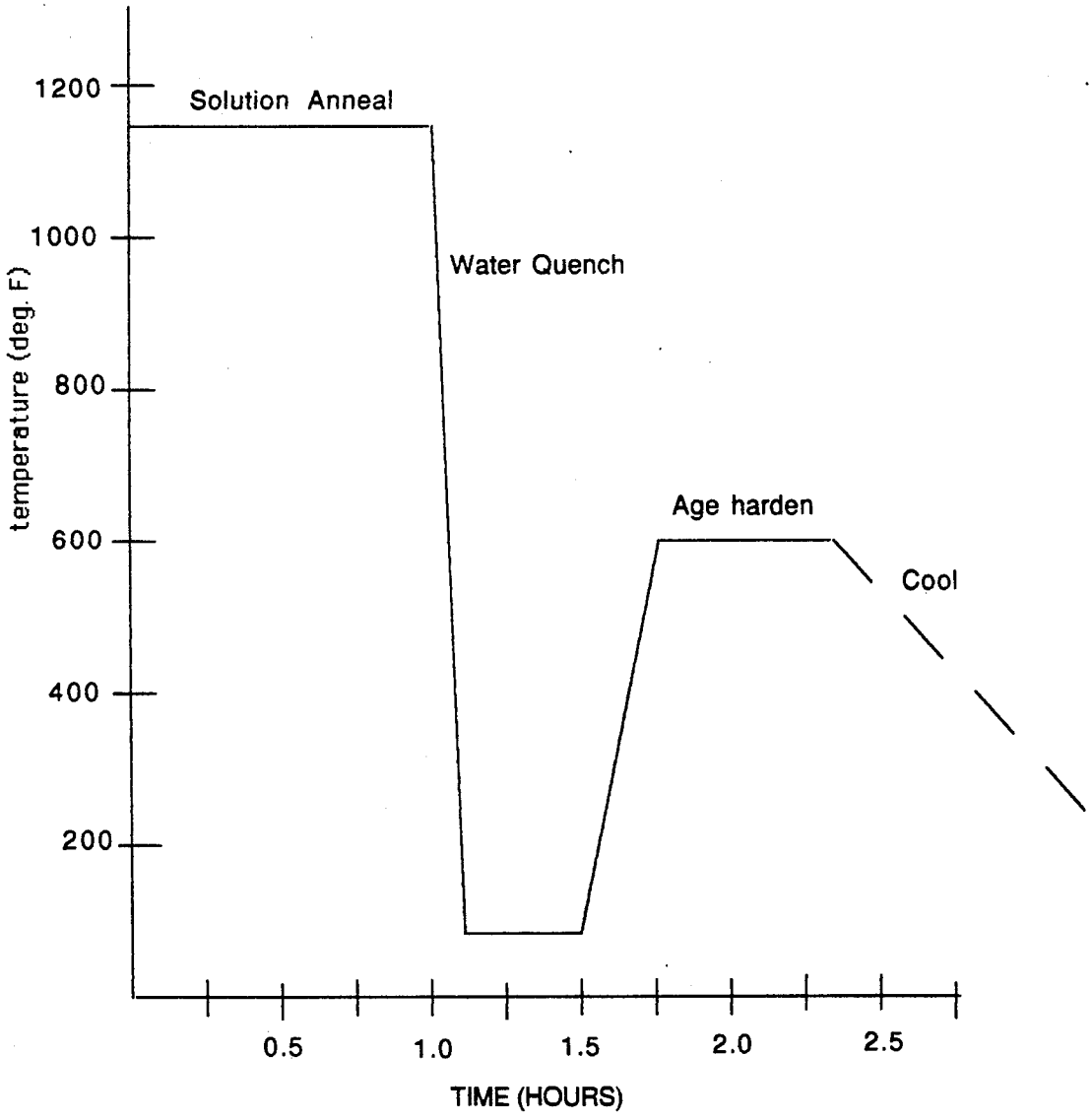
1200
1000
800
600
400
200
temperature (deg. F)
Solution Anneal
Water Quench
Age harden
Cool
0.5
1.0
1.5
2.0
2.5
TIME (HOURS)

GOLD ALLOYS OF EXCEPTIONAL YELLOW COLOR AND REVERSIBLE HARDNESS

FIELD OF THE INVENTION

This invention in it's most simple form or embodiment is concerned generally with gold compositions of exceptional and reversible hardness and at the same time having a yellow color which has previously not been achievable in combination with the desirable level of reversible hardness. Particularly, the invention is concerned with gold alloy composition used in the jewelry industry and which have an exceptional balance of color, formability and hardness. It is more particularly directed to 14 karat gold alloys containing gold, silver, copper, zinc, cobalt and an alternative alloy additionally containing iridium. Even more particularly, the components of gold alloys are in unique ratios. These ratios provide for alloys having most desirable yellow color, are easy to manufacture and are of such a character that exceptional and reversible hardness by subsequent and well known methods of heat treatment is easily achievable. The alloy which also contains a weight percent amount of iridium provides a gold alloy with the above characteristics but additionally the alloy has a very fine grained structure.

DESCRIPTION OF THE PRIOR ART

It has been recognized for many centuries that pure gold is extremely soft and must be strengthened for even the least demanding applications and particularly for use in the jewelry market. For this reason, many methods of hardening gold have been introduced: the primary methods being alloying and mechanical working. Mechanical working will increase the disorder in the gold metal crystal producing a phenomenon known as work hardening. This process is reversible in that elevated temperatures return the strength of the metal to that of the unworked solid solution or the pure metal. Unfortunately, undesirable hardening often takes place during the forming of gold articles. The metal becomes harder as it is formed, not softer, and subsequent application of heat to the fully formed article will soften it. Although, many metalsmiths continue to take advantage of the added strength obtained by mechanical working of the metal, this method of hardening cannot always be employed and does not always permit the optimum hardness during processing.

In comparison, the method of alloying achieves added strength through solid solution hardening. It is commonly recognized that a mixture of two different metals is always stronger than one of the two pure metals itself.

Gold based alloys have been used for centuries for the manufacture of jewelry. Typically yellow karat alloys containing mainly gold, silver, copper and zinc for each karat category. For 14 karat gold, the gold content is fixed at 58.3% by weight and therefore the amounts of the other elements are determined and provided in such a way as to obtain the most esthetically pleasing gold color. Often, small amounts of other elements such as nickel, iron, silicon or boron are added to obtain fine grained structure, improved ductility and hardness. This form of hardening is not reversible in that the alloy once formed cannot be returned to the strength of the individual metals that formed it. It is generally necessary to work alloys at their full strength.

While other methods of strengthening precious metals are known including control of the grain size and crystal dispersion strengthening, the magnitude of the strengthening is found to be very small at best. As a result, the only practical approach has become the preparation of different gold containing alloys which are then mechanically work hardened or age hardened at elevated temperatures to provide gold alloys of increased hardness.

Inventions related to the instant invention and disclosed in the following United States Patents have been studied. The following is a brief description and discussion of the most relevant of these related inventions.

U.S. Pat. No. 2,141,157 to Peterson is directed to a gold alloy consisting of about 33% to 84% gold, 10% to 67% copper, 0.1% to 5% cobalt 2.0% to 10% silver and 2.0% to 10% zinc. In this Peterson invention, cobalt is used to obtain non-reversible hardening. U.S. Pat. No. 2,229,463 to Leach teaches gold alloys containing 35% to 75% gold, 5% to 25% silver, 12% to 35% copper, 0.1% to 12% zinc and 1% to 5% iron. The use of iron here gives both reversible and non-reversible hardening but the color is seriously and negatively affected. U.S. Pat. No. 2,248,100 to Loebich discloses alloys containing 33% to 66% gold, 1% to 30% silver, 10% to 55% copper, 0.5% to 15% zinc and 0.1% to 5% iron. Taylor et al U.S. Pat. No. 5,045,411 teaches alloy compositions of gold, silver, copper, zinc plus amounts of other listed metals similar to the alloys of Peterson. However, the Taylor et al invention makes some improvements in some of the properties by adding a number of additives such as iron, indium, silicon, boron and nickel. Tuccillo U.S. Pat. No. 3,981,723 discloses white gold alloys containing palladium, silver, indium, with iridium (0.005%) or ruthenium. These alloys are most used in dental applications where a reduction in the grain size in castings leads to improvement in some mechanical properties.

Despite these innovations, the presently available 14 karat gold alloys do not have the esthetically pleasing yellow color and the exceptional reversible hardness that the gold alloy of the present invention has. For this reason, a gold alloy for use in the manufacture of high quality jewelry having a most desirable yellow color and which could be subsequently hardened and which would then demonstrate significant increases of hardness as well as reversible hardness and a hardness which makes the jewelry pieces more resistant to abrasions would represent a major advance and improvement in this art. Insofar as is presently known, 14 karat gold alloys demonstrating exceptional and reversible hardness and also having the desirable amount of yellow color, though highly useful and desirable, have not been available.

SUMMARY OF THE INVENTION

Basically the present invention in it's most simple form or embodiment is directed to a 14 karat very yellow gold alloy containing approximately 58.3% gold, and copper, silver and zinc within certain proportions such that a small addition of cobalt in the range of about 0.5% gives a dramatic improvement in hardness upon heat treatment of the alloy in known ways. The color of the resultant alloy is virtually indistinguishable from the most popular alloys which are not amenable to heat treatment. Preferably the gold alloys of the invention are melted and processed into a jewelry article in a normal manner with intermediate anneals as needed to obtain the final shape. After the article is formed, it is heated in an oven to a temperature of approximately 1150° F. for about 30 minutes and then quenched in water to retain the solution treated condition. Subsequently, the alloys are heat treated at a temperature of about 600° F. for one (1) to one and one half (1½) hours. This heat treatment gives a dramatic improvement in hardness from approximately 150 VHN (Vickers Hardness Number) to 250 VHN. The preferred alloys have both acceptable color and hardenability and it is noted that the H value/ratio is about 2.1 and the C value/ratio is about 1.5. Thus it is discovered that the desirable color is obtained if the color ratio i.e., the C value is maintained between about 1.5 and about 2.0. At a C value of 2.5 the alloys tend to become too pink and at around values of about 1.0 or less the color of the alloys is too pale.

In a similar manner, the desirable hardenability is obtained when the hardenability ratio, i.e., the H ratio or value is about 2.0.

It is a particular object of the present invention to provide, a unique hardenable gold based alloy, especially a 14 karat alloy containing gold, silver, copper, zinc, cobalt and an alternative alloy additionally containing iridium. The alloy has a fine grained structure, a lower hardness in the soft condition, a nice yellow color and a capability to be hardened to an exceptional hardness value. The alloy contains approximately not less than 58.03% gold (Au), between about 10% to about 14% silver (Ag) but not less than 10% silver, between about 2.0% to about 3.0% zinc (Zn) but not less than 2.0% zinc, between about 0.2% to about 1.0% cobalt (Co) but not less than about 0.2% Cobalt and the balance of the alloy being copper (Cu) with the special provision that the ratio of the weight percent amounts of copper to, the sum of the silver and two (2) times the zinc amount, [Cu/(Ag+2Zn)], has a value of between about 1.3 to 2.5. The copper to silver weight percent ratio [Cu/Ag] of between about 2.0 to about 3.8, in combination with the ratio of copper to, silver+2×zinc, [Cu/(Ag+2Zn)] results in a gold alloy with a heretofor unachievable combination of a most desirable yellow color and an exceptional degree of reversible hardness. The alloy may also contain a weight percent amount of between about 0.003 to about 0.03 iridium (Ir) which results in a gold alloy with the above characteristics but also provides for an alloy having a very fine grained structure.

The primary object of the present invention is to provide a hardenable gold alloy comprising not less than about 58.03% gold; not less than about 10.0% silver; not less than about 2.0% zinc; not less than about 0.2% cobalt and the balance of the alloy being copper. The alloy may also contain not less than 0.003% iridium to reduce the grain size of the resultant alloy. The preferred alloys have both acceptable color and hardenability and it is noted that the ratio of the weight percent of copper to the weight percent of silver (the hardness ratio) is about 2.1 and the ratio of the weight percent of copper to, the sum of the weight percent of silver and twice the weight percent of zinc (the color ratio) is about 1.5. Thus it is discovered that the desirable color is obtained if the color ratio i.e., the C value is maintained between about 1.5 and about 2.0. At a C value of 2.5 the alloys tend to become too pink and at around values of about 1.0 or less the color of the alloys is too pale.

In a similar manner, the desirable hardenability is obtained when the hardenability ratio, i.e., the H ratio or value is about 2.0.

Preferably, the metals comprising the alloy are combined and heated to a temperature not substantially less than 1100° F. to anneal the alloy into a solid solution. The annealed alloy is then quickly cooled by quenching to ambient temperature. The annealed alloy is then preferably age hardened by subjecting the alloy to a temperature ranging between 300° F.-700° F. for a predetermined time period followed by cooling of the age hardened alloy to ambient temperature. The age hardened gold alloy demonstrates a hardness substantially greater than that of traditional 14 karat yellow gold alloy typically 110-150 VHN (Vickers Hardness Number) and is capable of being reversed by elevated temperatures into a relatively soft alloy state.

These and further objects of the present invention will become apparent to those skilled in the art after a study of the present disclosure of the invention and with reference to the accompanying drawing which is a part hereof, and in which:

BRIEF DESCRIPTION OF THE DRAWINGS

The present invention may be more easily and completely understood when taken in conjunction with the accompanying drawing, in which:

The FIGURE is a graph illustrating the solution annealing process and the age hardening process useful with the present invention.

DESCRIPTION OF THE PREFERRED EMBODIMENTS

The gold alloy of the present invention, has many variations in the composition of the alloy all within the definition of the limits of the amounts of the components as defined in the claims. However, the preferred embodiments can be best described by discussing the alloys listed in Tables 1A and 1B and comparing them with the prior art alloys.

All of the alloys in Tables 1A and 1B contain 58.25% gold which represents the karat value of 14. The gold content may be reduced to about 58.03% and still be within the definition of 14 karat. The alloys listed are melted in a normal fashion except that any addition of cobalt is accomplished by using a master alloy comprising 90% by weight copper and 10% cobalt. If cobalt is added in the pure state, the resultant alloys often have large aggregations of cobalt and the properties achieved are not optimized. Similarly, any addition of iridium is also accomplished by adding a master alloy comprising 95% copper and 5% iridium.

TABLE 1A

| | Weight % The % of Au for all Alloys is about 58.25 | | | | | | Hardness | | Color | |
|---|---|---|---|---|---|---|---|---|---|---|
| | | | | | | | Annealed | Aged | Yellow | Red |
| Alloy | % Ag | % Zn | % Co | % Ir | % Ni | % Cu | VHN # | VHN # | "b*" | "a*" |
| 1 | 3.8 | 5.8 | — | — | 0.35 | 31.80 | 120 | 130 | 18.6 | 2.8 |
| 2 | 3.8 | 5.8 | 0.8 | — | 0.35 | 31.00 | 155 | 156 | 17.7 | 2.6 |
| 3 | 3.8 | 4.7 | 0.8 | — | — | 32.25 | 150 | 150 | 19.9 | 4.0 |
| 4 | 12.2 | 4.7 | 0.4 | — | — | 14.45 | 153 | 248 | 20.0 | 1.0 |

TABLE 1A-continued

| Alloy | Weight % The % of Au for all Alloys is about 58.25 % Ag | % Zn | % Co | % Ir | % Ni | % Cu | Hardness Annealed VHN # | Aged VHN # | Color Yellow "b*" | Red "a*" |
|---|---|---|---|---|---|---|---|---|---|---|
| 5 | 12.2 | 2.7 | 0.5 | — | — | 26.35 | 166 | 258 | 20.5 | 3.15 |
| 6 | 12.2 | 2.7 | 0.4 | — | — | 26.45 | 151 | 246 | 19.7 | 3.15 |
| 7 | 12.2 | 2.7 | 0.6 | — | — | 26.25 | 177 | 275 | 20.0 | 3.2 |
| 8 | 6.1 | 4.7 | 0.6 | — | — | 30.35 | 150 | 150 | 19.5 | 3.0 |
| 9 | 8.0 | 4.7 | 0.8 | — | — | 30.15 | 155 | 160 | 18.3 | 2.8 |
| 10 | 10.0 | 2.7 | 1.0 | — | — | 28.05 | 183 | 248 | 18.6 | 3.75 |
| 11 | 12.2 | 2.7 | 0.4 | 0.005 | — | 26.40 | 155 | 245 | 19.5 | 3.1 |
| 12 | 12.2 | 2.7 | 0.6 | 0.005 | — | 26.20 | 180 | 276 | 19.7 | 3.1 |

TABLE 1B

| Alloy | Weight % The % of Au for all Alloys is about 58.25 % Ag | % Zn | % Co | % Ir | % Ni | % Cu | Hardness Ratio Cu/Ag "H" | Color Ratio Cu/(Ag + 2 Zn) "C" | Remarks Acceptable? Hardness | Color |
|---|---|---|---|---|---|---|---|---|---|---|
| 1 | 3.8 | 5.8 | — | — | 0.35 | 31.80 | 8.37 | 2.06 | no | OK |
| 2 | 3.8 | 5.8 | 0.8 | — | 0.35 | 31.00 | 8.16 | 2.01 | no | OK |
| 3 | 3.8 | 4.7 | 0.8 | — | — | 32.25 | 8.49 | 2.44 | no | marginal |
| 4 | 12.2 | 4.7 | 0.4 | — | — | 14.45 | 2.0 | 1.13 | yes | no |
| 5 | 12.2 | 2.7 | 0.5 | — | — | 26.35 | 2.16 | 1.50 | yes | yes |
| 6 | 12.2 | 2.7 | 0.4 | — | — | 26.45 | 2.17 | 1.50 | yes | yes |
| 7 | 12.2 | 2.7 | 0.6 | — | — | 26.25 | 2.15 | 1.49 | yes | yes |
| 8 | 6.1 | 4.7 | 0.6 | — | — | 30.35 | 4.9 | 1.96 | no | OK |
| 9 | 8.0 | 4.7 | 0.8 | — | — | 30.15 | 3.77 | 1.73 | no | OK |
| 10 | 10.0 | 2.7 | 1.0 | — | — | 28.05 | 2.8 | 1.82 | OK | marginal |
| 11 | 12.2 | 2.7 | 0.4 | 0.005 | — | 26.40 | 2.16 | 1.50 | OK | fine grn OK |
| 12 | 12.2 | 2.7 | 0.6 | 0.005 | — | 26.20 | 2.14 | 1.50 | OK | fine grn OK |

EXAMPLE 1

The alloy #1 in Tables 1A and 1B represents one of the most common jewelry alloys. It has the most esthetic gold color, fine grained structure and excellent formability needed for manufacturing jewelry components using mechanical operations. This alloy is similar in composition to the ones described by Peterson and Taylor. The vickers hardness of the alloy is 120 after solution anneal and it increases insignificantly to 130 on heat treatment as described in FIG. 1. Until a few years ago, the colors of these alloys could be described only in words such as deep yellow, pale yellow, pink etc. However, with the availability of computer controlled spectrophotometers, it is now possible to describe the colors using a three dimensional space and numbers which vary from 0 to + or −100. This quantitative measurement of color makes the comparison between two alloys much more meaningful. The system used here is called CIE Lab System. In this system L represents the brightness and since the brightness of the alloys listed in the table does not vary much it is not given in the table. The b* component listed represents the yellow coordinate and a* represents the red component. The instrument used was MACBETH COLOR EYE® 1500 Plus brand of color spectrophotometer. For detailed description of color measuring systems, reference is made to ASTM Standards on color and appearance measurements. The yellow component of this alloy is 18.6 and the a value is 2.8.

EXAMPLE 2

Example #2 has the same composition as alloy #1 except that 0.8% by weight of cobalt has been added. This addition has increased the hardness from a value of 120 to 155 in the annealed condition. This type of irreversible hardness increase was stipulated by Peterson in U.S. Pat. No. 2,141,157. However, it is not possible to heat treat this alloy to increase the hardness further. If higher amounts of cobalt are used, the annealed hardness increases further and makes the alloy unsuitable for many intricate fabrication processes. The higher amounts of cobalt also affect the color detrimentally.

EXAMPLE 3

Example 3 is another alloy with the same amount of cobalt but without nickel and a slightly lower zinc content. This alloy has a red component a* value of 4.0 which is considered an upper limit of acceptability for these yellow alloys. This alloy also does not harden on heat treatment.

EXAMPLE 4

Example 4 describes another alloy which can be heat treated to increase the hardness but the red component of this alloy is 1.0 which is considered too pale to be acceptable. Visually, this alloy looks pale yellowish green compared to the desirable color of alloy #1.

EXAMPLES 5, 6 and 7

The most preferred compositions of this invention are given Examples 5, 6, and 7. These alloys have annealed hardnesses that vary from 151 to 177 and it can be controlled by controlling the amount of cobalt addition. The higher the cobalt concentration the higher the annealed hardness. The most preferred alloys should not exceed the annealed hardness of approximately 180 and therefore the cobalt addition has to be limited to about 1.0%. Above this level, cobalt addition is detrimental to the color also. These alloys can be formed into very intricate shapes in the soft condition after which the hardness can be increased by almost 100 points by heat treatment. Both the yellow and the red components of these alloys are in the most preferred range.

To understand the preferred embodiments of this invention, it is very useful to discuss the two composition ratios listed in the tables 1A and 1B. The first ratio is the ratio of copper to silver content of the alloy and it will be designated as ratio "H". The other ratio is copper to, silver plus twice the zinc content, and this ratio will be designated as the "C" ratio.

The alloys 1 and 2 which have desirable color but no hardenability have a Cu/Ag, or the H value of 8.2 and Cu/(Ag+2Zn) or C value of about 2.0. Alloy 3 has similar H value and a slightly higher C value. Alloy 4 which has unacceptable color but desirable hardenability has an H value of about 2.0 and a C value of about 1.0. The preferred alloys 5, 6 and 7 have both acceptable color and hardenability and it is noted that the H value/ratio is about 2.1 and the C value/ratio is about 1.5. Thus it is discovered that the desirable color is obtained if the color ratio i.e., the C value is maintained between about 1.5 and about 2.0. At a C value of 2.5 the alloys tend to become too pink and at around values of about 1.0 or less the color of the alloys is too pale.

In a similar manner, the desirable hardenability is obtained when the hardenability ratio, i.e., the H ratio or value is about 2.0 and not around 8.0 as is the case with prior art alloys.

EXAMPLES 8, 9 and 10

Alloys according to examples 8, 9 and 10 further illustrate the importance and the uniqueness of these ratios. Both alloys 8 and 9 have acceptable color and the color ratio C value is about 1.8 and the alloys are with the acceptable limits of 1.5 and 2.0. However, the hardenability ratios vary from 3.8 to 5.0 which is too high to achieve the acceptable hardness characteristics. Alloy number 10 seems to indicate an upper limit for the hardenability ratio H of about 2.8. If enough cobalt is added, the alloy achieved acceptable hardenability but both the color and the hardness in the soft state reach a borderline of acceptability.

EXAMPLES 11 and 12

Alloys 11 and 12 demonstrate the synergistic affect of adding both cobalt and iridium to the preferred alloys. The effectiveness of cobalt in reducing the grain size of the alloy on annealing has been discussed before. The effect of iridium addition to yellow gold alloys has not been discussed but in the prior art the effectiveness in reducing the grain size of castings is discussed. Alloys 11 and 12 have the same composition as alloys 6 and 7 except that 11 and 12 contain about 50 ppm of iridium. The alloys without either cobalt or iridium have a grain size after annealing of about 35 microns. This reduces to a value of approximately 20 microns when cobalt is added. The iridium addition alone does not reduce the annealed hardness substantially. However, if iridium is added to the preferred alloys the grain size is reduced to a value of about 10 microns which makes the alloys even more desirable for intricate forming operations.

The present invention is a hardenable, gold alloy comprising either five, six or seven different metals with exceptional color and which after annealing and heat treatment demonstrate a substantially increased hardness which is reversible upon additional application of heat.

The preferred embodiment of the present invention exhibits or demonstrates particularly useful advantages with the use of very particular ratios to produce a gold alloy which is then able to be heat treated in a predetermined manner to yield an alloy of exceptional hardness and pleasing and desirable color relative to presently known 14 karat gold alloys. While the use of cobolt in gold alloys is known in this art, the use of such cobalt, in small amounts, along with the ratio of Cu to Ag and the ratio of Cu to, the sum of Ag and twice zn, has not been known nor have the advantages been known.

The gold alloys provide exceptional hardness in comparison to the hardness of previously available 14 karat gold blends. The present invention also provides several other major advantages and features which were not previously available for 14 karat gold alloys. Alloys made in accordance with the present invention, be they quinary, or senary systems in composition, yield a gold alloy with reversible hardness. Each alloy can be resoftened by subsequent heating and quenching to yield the alloy in its original blended state; this softened alloy can then be hardened again by a subsequent precipitation heat treatment. This process relies on the precipitation of a minor metal phase to precipitate out of the major gold phase upon heating to cause lattice distortion and hardening of the alloy.

Another major characteristic of the gold alloys made in accordance with the present invention is their non-toxic character—that is, they can be used without fear of any ill effects caused by the metals used in making the alloy. It is commonly recognized that gold alloys employing beryllium are not desirable for use as jewelry or articles intended for contact with food because beryllium is a toxic metal. The present invention comprising any of the alloy systems is known to be non-toxic.

The gold alloys described herein demonstrate a strong springback quality and are resistant to deformation. These qualities are particularly desirable in jewelry applications in that clasps will remain more secure due, at least in part, to the strong springback quality. The finish will demonstrate a greater resistance to scratches and dents - thus making the jewelry item more attractive and valuable to its owner. In addition, when the novel gold alloys are utilized in the making of articles in hollow and/or flat goldware, their demonstrated and improved hardness permits the manufacturer to utilize thinner walls of the alloy in their construction and thus make the article available at a lower cost to the consumer. It is also expected that many advantages in both the springback quality and deformation resistance will be useful in the electronics industry, for example in the making of contact relays.

The making of the gold alloy follows procedures conventionally known in the art. Initially it is preferred that master alloys containing 90% Cu with 10% Co and 95% Cu with 5% Ir are preferred. The final alloys are then formed in the conventional manner to obtain the final product.

The alloy blend is then annealed for a predetermined period of time at an elevated temperature. The temperature for solid solution annealing will vary with the composition of the intermetallic compound added to the silver and copper in the alloy. The suitable annealing temperature is one which will substantially soften the alloy.

A range of temperatures between 1100° F.-1250° F. is deemed to be useful for annealing purposes. Optimally, it has been found that an anneal of 1100° F. for 1 and ½ hours is best for successful hardening of the annealed alloy subsequently. Furthermore, while 1 and ½ hours of annealing time was considered optimum. this annealing time may be varied from ½ hour to 4 hours depending upon the variety and quantity of metals as well as the thickness of the product being produced.

Subsequently, at the end of the annealing duration, the solid solution of metals is cooled rapidly or quenched thereby bringing the alloy to ambient room temperature. After quenching. the alloy is preferably age hardened to obtain the precipitation hardening effect. Age hardening comprises elevating the alloy to a temperature ranging from 300° F.-700° f., and maintaining the alloy at this temperature uniformly for a period ranging typically from ½ to 4 hours. Testing has demonstrated that the optimum aging time and temperature is about 600° F. for one hour to produce the highest hardness in the alloy for most embodiments of the present invention. The age-hardened alloy is then allowed to cool to ambient room temperature. The entirety of these processing steps are summarized by FIG. 1.

It will be clearly understood that the present invention comprises the making of gold alloys comprising five, or six and even seven (nickel) different metals subsequent to annealing of the alloy and age-hardening the alloy. It would be also understood that the alloys of this invention may be work hardened rather than age-hardened. Accordingly, the invention is a hardenable gold alloy whose characteristic properties of exceptional and reversible hardness are demonstrable and measurable only after the solution annealing and age-hardening prosesses have been completed. In addition, it will be clearly and explicitly understood, that while specific quantities of individual metals as weight percents are identified for specific embodiments, each of these are merely illustrative of the present invention as a whole; none of these parameters are deemed to limit or restrict the scope of the present invention in any manner.

I claim:

1. A gold based alloy composition comprising:
not less than about 58.03 weight percent gold;
not less than about 10.0 weight percent silver;
not less than about 2.0 weight percent zinc;
not less than about 0.2 weight percent cobalt;
copper in weight percent amount equal to 100 less the sum total of the weight percent of said gold, silver, zinc and cobalt;
a ratio of said copper amount to said silver amount being between about 2.0 and about 3.8; and
a ratio of said copper amount to, sum total of said silver amount plus twice said zinc amount, being between about 1.3 and about 2.5.

2. A gold based alloy composition comprising:
not less than about 58.03 weight percent gold;
not less than about 10.0 weight percent silver;
not less than about 2.0 weight percent zinc;
not less than about 0.2 weight percent cobalt;
not less than about 0.003 weight percent iridium;
copper in weight percent amount equal to 100 less the sum total of the weight percent of said gold, silver, zinc,. cobalt and iridium;
a ratio of said copper amount to said silver amount being between about 2.0 and about 3.8; and
a ratio of said copper amount to, sum total of said silver amount plus twice said zinc amount, being between about 1.3 and about 2.5.

* * * * *

US005180551A

REEXAMINATION CERTIFICATE (2679th)

United States Patent [19]

[11] B1 5,180,551

Agarwal

[45] Certificate Issued Sep. 19, 1995

[54] GOLD ALLOYS OF EXCEPTIONAL YELLOW COLOR AND REVERSIBLE HARDNESS

[75] Inventor: Dwarika P. Agarwal, Attleborough, Mass.

[73] Assignee: Swiss Bank Corporation, New York, N.Y.

Reexamination Requests:
No. 90/003,512, Jul. 29, 1994
No. 90/003,526, Aug. 9, 1994

Reexamination Certificate for:

| | |
|---|---|
| Patent No.: | **5,180,551** |
| Issued: | **Jan. 19, 1993** |
| Appl. No.: | **784,766** |
| Filed: | **Oct. 30, 1991** |

[51] Int. Cl.[6] ..... C22C 5/02
[52] U.S. Cl. ..... 420/511; 148/405; 148/501
[58] Field of Search ..... 420/511; 148/405, 430, 148/501, 678

[56] References Cited

U.S. PATENT DOCUMENTS

| | | | |
|---|---|---|---|
| 2,169,592 | 8/1938 | Peterson | 420/511 |
| 3,981,723 | 9/1976 | Tuccillo | 75/165 |
| 5,173,132 | 12/1992 | Solomon | 148/405 |
| 5,180,551 | 1/1993 | Agarwal | 420/511 |

FOREIGN PATENT DOCUMENTS 62-259042 10/1988 Japan .

OTHER PUBLICATIONS

Grain Refining in 14K Gold Alloys, Gal-Or et al. The Santa Fe Symposium on Jewelry Manufacturing Technology (1987), Ed. by D. Schneller, Met-Chem Research, Inc., Boulder, Colo. (1988), 125-141.

*Primary Examiner*—George Wyszomierski

[57] ABSTRACT

A unique hardenable gold based alloy, especially a 14 karat gold alloy containing gold, silver, copper, zinc, cobalt and an alternative alloy additionally containing iridium. The alloy has a fine grained structure, a lower hardness in the soft condition, a nice yellow, color and a capability to be hardened to an exceptional hardness value. The alloy contains approximately 58.3% gold (Au), between about 10% to about 14% silver (Ag), between about 2.5% to about 3.0% zinc (Zn), between about 0.2% to about 1.0% cobalt (Co) and the balance of the alloy being copper (Cu) with the special provision that the ratio of the weight percent amounts of copper to, the sum of the silver and two (2) times the zinc amount, [Cu/Ag+2Zn)], has a value of between about 1.3 to about 2.5. The copper to silver weight percent ratio [Cu/Ag] of between about 2.0 to about 3.8, in combination with the ratio of copper to, silver+2×zinc, [Cu/Ag+2Zn)] results in a gold alloy with a heretofor unachievable combination of a most desirable yellow color and an exceptional degree of reversible hardness. The alloy may also contain a weight percent amount of between about 0.003 to about 0.03 iridum (Ir) which results in a gold alloy with the above characteristics but also provides for an alloy having a very fine grained structure.

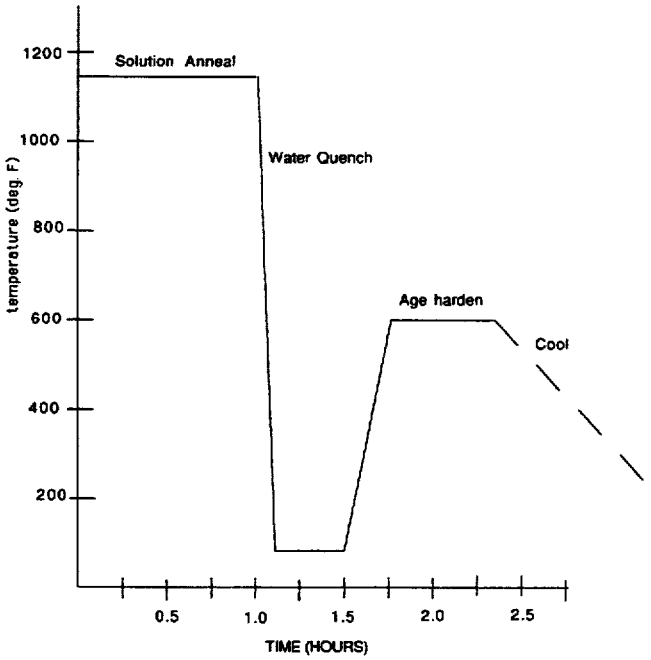

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 are determined to be patentable as amended.

New claims 3–12 are added and determined to be patentable.

1. A [gold based] *hardenable gold-based* alloy composition [comprising], *consisting essentially of:*
not less than about 58.03 weight percent gold;
not less than about 10.0 weight percent silver;
not less than about 2.0 weight percent zinc;
not less than about 0.2 weight percent cobalt;
copper in weight percent amount equal to 100 less the sum total of the weight percent of said gold, silver, zinc and cobalt;
[a] *the* ratio of said copper amount to said silver amount being between about 2.0 and about 3.8; [and]
[a] *the* ratio of said copper amount to[,] *the* sum total of said silver amount plus twice said zinc amount[,] being between about 1.3 and about 2.5;
*said composition having a gold color which has a yellow component in the range of about 17.7 to about 20.5 CIE units, and a red component in the range of about 2.6 to about 4.0 CIE units; and*
*said composition being capable of being selectively hardened to at least 150% of its annealed hardness.*

2. A [gold based] *hardenable gold-based* alloy composition [comprising], *consisting essentially of:*
not less than about 58.03 weight percent gold;
not less than about 10.0 weight percent silver;
not less than about 2.0 weight percent zinc;
not less than about 0.2 weight percent cobalt;
not less than about 0.003 weight percent iridium;
copper in weight percent amount equal to 100 less the sum total of the weight percent of said gold, silver, zinc, cobalt and iridium;
[a] *the* ratio of said copper amount to said silver amount being between about 2.0 about 3.8; [and]
[a] *the* ratio of said copper amount to[,] *the* sum total of said silver amount plus twice said zinc amount[,] being between about 1.3 and about 2.5;
*said composition having a gold color which has a yellow component in the range of about 17.7 to about 20.5 CIE units, and a red component in the range of about 2.6 to about 4.0 CIE units; and*
*said composition being capable of being selectively hardened to at least 150% of its annealed hardness.*

*3. A gold-based alloy composition as set forth in claim 1 wherein the original hardness of said composition is capable of being restored by heating and quenching.*

*4. A gold-based alloy composition as set forth in claim 2 wherein the original hardness of said composition is capable of being restored by heating and quenching.*

*5. A gold-based alloy composition as set forth in claim 1 wherein said composition is essentially free of nickel.*

*6. A gold-based alloy composition as set forth in claim 2 wherein said composition is esentially free of nickel.*

*7. A gold-based alloy composition as set forth in claim 1 wherein the original hardness of said composition is capable of being restored by heating and quenching, and wherein said composition is essentially free of nickel.*

*8. A gold-based alloy composition as set forth in claim 2 wherein the original hardness of said composition is capable of being restored by heating and quenching, and wherein said composition is essentially free of nickel.*

*9. A gold-based alloy composition, consisting of:*
*not less than about 58.03 weight percent gold;*
*not less than about 10.0 weight percent silver;*
*not less than about 2.0 weight percent zinc;*
*not less than about 0.2 weight percent cobalt;*
*copper in weight percent amount equal to 100 less the sum total of the weight percent of said gold, silver, zinc and cobalt;*
*the ratio of said copper amount to said silver amount being between 2.0 and about 3.8; and*
*the ratio of said copper amount to the sum total of said silver amount plus twice said zinc amount being between about 1.3 and 2.5.*

*10. A gold-based alloy composition, consisting of:*
*not less than about 58.03 weight percent gold;*
*not less than about 10.0 weight percent silver;*
*not less than about 2.0 weight percent zinc;*
*not less than about 0.2 weight percent cobalt;*
*not less than about 0.003 weight percent iridium;*
*copper in weight percent amount equal to 100 less the sum total of the weight percent of said gold, silver, zinc, cobalt and iridium;*
*the ratio of said copper amount to said silver amount being between 2.0 and about 3.8; and*
*the ratio of said copper amount to the sum total of said silver amount plus twice said zinc amount being between about 1.3 and 2.5.*

*11. A gold-based alloy composition, the annealed hardness of which is capable of being restored by heating and quenching, consisting essentially of:*
*not less than about 58.03 weight percent gold;*
*not less than about 10.0 weight percent silver;*
*not less than about 2.0 weight percent zinc;*
*not less than about 0.2 weight percent cobalt;*
*copper in weight percent amount equal to 100 less the sum total of the weight percent of said gold, silver, zinc, and cobalt;*
*the ratio of said copper amount to said silver amount being between about 2.0 and about 3.8;*
*the ratio of said copper amount to the sum total of said silver amount plus twice said zinc amount being between about 1.3 and 2.5;*
*said composition having a gold color which has a yellow component in the range of about 17.7 to about 20.5 CIE units, and a red component in the range of about 2.6 to about 4.0 CIE units; and*
*said alloy composition having a hardness in an annealed condition of less than about 180 VHN.*

*12. A gold-based alloy composition, the annealed hardness of which is capable of being restored by heating and quenching, consisting essentially of:*
*not less than about 58.03 weight percent gold;*
*not less than about 10.0 weight percent silver;*

*not less than about 2.0 weight percent zinc;*

*not less than about 0.2 weight percent cobalt;*

*not less than about 0.003 weight percent iridium;*

*copper in weight percent amount equal to 100 less the sum total of the weight percent of said gold, silver, zinc, cobalt, and iridium;*

*the ratio of said copper amount to said silver amount being between about 2.0 and about 3.8;*

*the ratio of said copper amount to the sum total of said silver amount plus twice said zinc amount being between about 1.3 and 2.5;*

*said composition having a gold color which has a yellow component in the range of about 17.7 to about 20.5 CIE units, and a red component in the range of about 2.6 to about 4.0 CIE units; and*

*said alloy composition having a hardness is an annealed condition of less than about 180 VHN.*

* * * * *

US005180551B1

REEXAMINATION CERTIFICATE (3722th)

United States Patent [19] [11] B2 5,180,551

Agarwal [45] Certificate Issued Feb. 9, 1999

[54] GOLD ALLOYS OF EXCEPTIONAL YELLOW COLOR AND REVERSIBLE HARDNESS

[75] Inventor: Dwarika P. Agarwal, Attleborough, Mass.

[73] Assignee: Fleet Precious Metals Inc., Providence, R.I.

Reexamination Request:
No. 90/005,049, Jul. 29, 1998

Reexamination Certificate for:

| | |
|---|---|
| Patent No.: | **5,180,551** |
| Issued: | **Jan. 19, 1993** |
| Appl. No.: | **784,766** |
| Filed: | **Oct. 30, 1991** |

Reexamination Certificate B1 5,180,551 issued Sep. 19, 1995

[51] Int. Cl.[6] ..... C22C 5/02
[52] U.S. Cl. ..... 420/511; 148/405; 148/501
[58] Field of Search ..... 420/511; 148/405, 148/430, 501, 678

[56] References Cited

U.S. PATENT DOCUMENTS 3,981,723 9/1976 Tuccillo .

FOREIGN PATENT DOCUMENTS 1216304 2/1990 Italy .

OTHER PUBLICATIONS

Article: Grain Refining in 14K Gold Alloys—Authors: Gal–Or, L. & Riabkina–Fishman, M.; The Santa Fe Symposium on Jewelry Manufacturing Technology (1987), Ed. by D. Schneller, Met–Chem Research, Inc., Boulder Colorado (1988), 125–141.,

*Primary Examiner*—George Wyszomierski

[57] ABSTRACT

A unique hardenable gold based alloy, especially a 14 karat gold alloy containing gold, silver, copper, zinc, cobalt and an alternative alloy additionally containing iridium. The alloy has a fine grained structure, a lower hardness in the soft condition, a nice yellow, color and a capability to be hardened to an exceptional hardness value. The alloy contains approximately 58.3% gold (Au), between about 10% to about 14% silver (Ag), between about 2.5% to about 3.0% zinc (Zn), between about 0.2% to about 1.0% cobalt (Co) and the balance of the alloy being copper (Cu) with the special provision that the ratio of the weight percent amounts of copper to, the sum of the silver and two (2) times the zinc amount, [Cu/Ag+2Zn)], has a value of between about 1.3 to about 2.5. The copper to silver weight percent ratio [Cu/Al] of between about 2.0 to about 3.8, in combination with the ratio of copper to, silver+2×zinc, [Cu/Ag+2Zn)] results in a gold alloy with a heretofor unachievable combination of a most desirable yellow color and an exceptional degree of reversible hardness. The alloy may also contain a weight percent amount of between about 0.003 to about 0.03 iridum (Ir) which results in a gold alloy with the above characteristics but also provides for an alloy having a very fine grained structure.

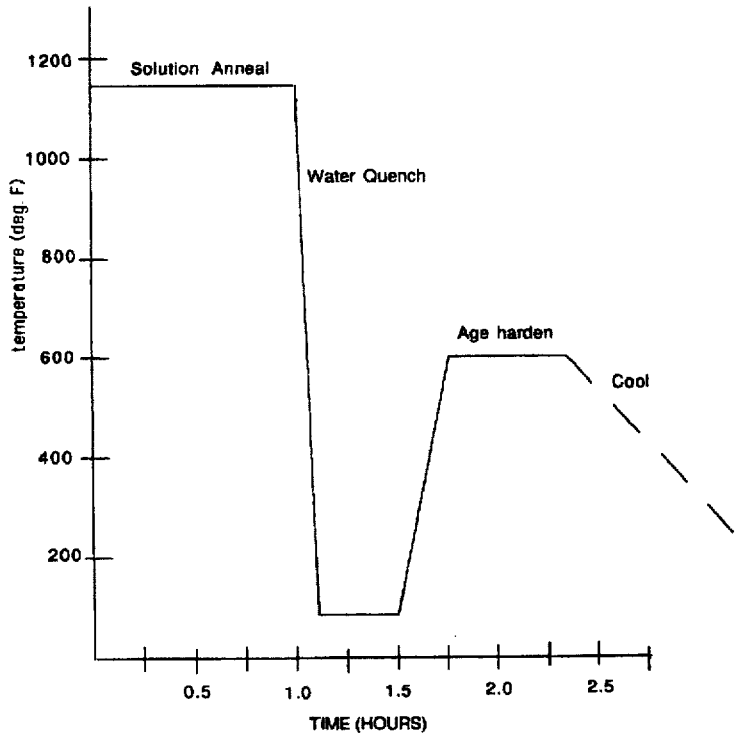

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *